United States Patent [19]

Shaw et al.

[11] Patent Number: 4,478,054

[45] Date of Patent: Oct. 23, 1984

[54] HELICAL SCREW ROTARY COMPRESSOR FOR AIR CONDITIONING SYSTEM HAVING IMPROVED OIL MANAGEMENT

[75] Inventors: David N. Shaw, Unionville; Clifford T. Bulkley, Glastonbury, both of Conn.

[73] Assignee: Dunham-Bush, Inc., West Hartford, Conn.

[21] Appl. No.: 513,182

[22] Filed: Jul. 12, 1983

[51] Int. Cl.[3] ..... F25B 27/00

[52] U.S. Cl. ..... 62/323.4; 418/98; 418/201; 418/DIG. 1

[58] Field of Search ..... 418/201, DIG. 1, 97, 418/98; 62/323.4

[56] References Cited

U.S. PATENT DOCUMENTS

| | | | |
|---|---|---|---|
| 1,626,768 | 5/1927 | Vollmann | 418/98 |
| 2,719,408 | 10/1955 | Penn . | |
| 3,200,603 | 8/1965 | Wake et al. . | |
| 3,263,435 | 8/1966 | Endress et al. . | |
| 3,543,880 | 12/1970 | Scott . | |
| 3,577,741 | 5/1971 | Shaw . | |
| 3,649,140 | 3/1972 | Harlin | 418/97 X |
| 3,825,372 | 7/1974 | Lundberg | 418/97 X |
| 3,902,827 | 9/1975 | Schibbye | 418/98 X |
| 3,945,216 | 3/1976 | Schibbye . | |
| 3,978,685 | 9/1976 | Taylor . | |
| 4,112,701 | 9/1978 | Schibbye et al. . | |
| 4,178,765 | 12/1979 | Slayton . | |
| 4,179,248 | 12/1979 | Shaw | 418/97 X |

FOREIGN PATENT DOCUMENTS

| | | | |
|---|---|---|---|
| 2948992 | 6/1981 | Fed. Rep. of Germany | 418/98 |

*Primary Examiner*—William E. Tapolcai
*Attorney, Agent, or Firm*—Sughrue, Mion, Zinn, Macpeak & Seas

[57] ABSTRACT

A helical screw rotary compressor for a closed loop refrigeration system such as an air conditioning system for a bus or like vehicle is connected in series with a condenser and an evaporator, in that order, with the evaporator at a raised position relative to the compressor and utilizes a vaporizable refrigerant which is miscible with a lubricating oil employed to lubricate the moving components of the screw compressor. The bus engine driven, clutch operated, helical screw rotors are mounted within parallel intersecting bores within the compressor housing. A slide valve underlies the intermeshed rotors and forms a portion of the screw compressor envelope, the rotors opening to a suction port connected to the outlet side of the evaporator above the rotors. A high pressure discharge port at one end of the intermeshed rotors leads to an auxiliary chamber bearing an unload cylinder which drives the slide valve and which opens at the top to a housing discharge port leading to the condenser. An oil separator is interposed within the auxiliary chamber above the unload cylinder. An oil drain passage leads from the auxiliary chamber to an oversized oil sump within the housing beneath the rotors. The slide valve slides in a recess within the casing underlying the rotors. On the suction port side of the recess, a further drain passage leads through a drainage check valve to the sump. This structural arrangement permits all condensed refrigerant and the oil to return by gravity flow to the oil sump whose capacity is at least 1.5 times the volume of the normal oil charge for the system. Condensed refrigerant miscible in the oil and the oil entraining the refrigerant, upon compressor shut down, accumulates in the sump but does not reach the intermeshed rotors and thus prevents clutch burnout by liquid locking during initiation of compressor operation with the clutch mechanically connecting the engine to the intermeshed helical screw rotors.

8 Claims, 1 Drawing Figure

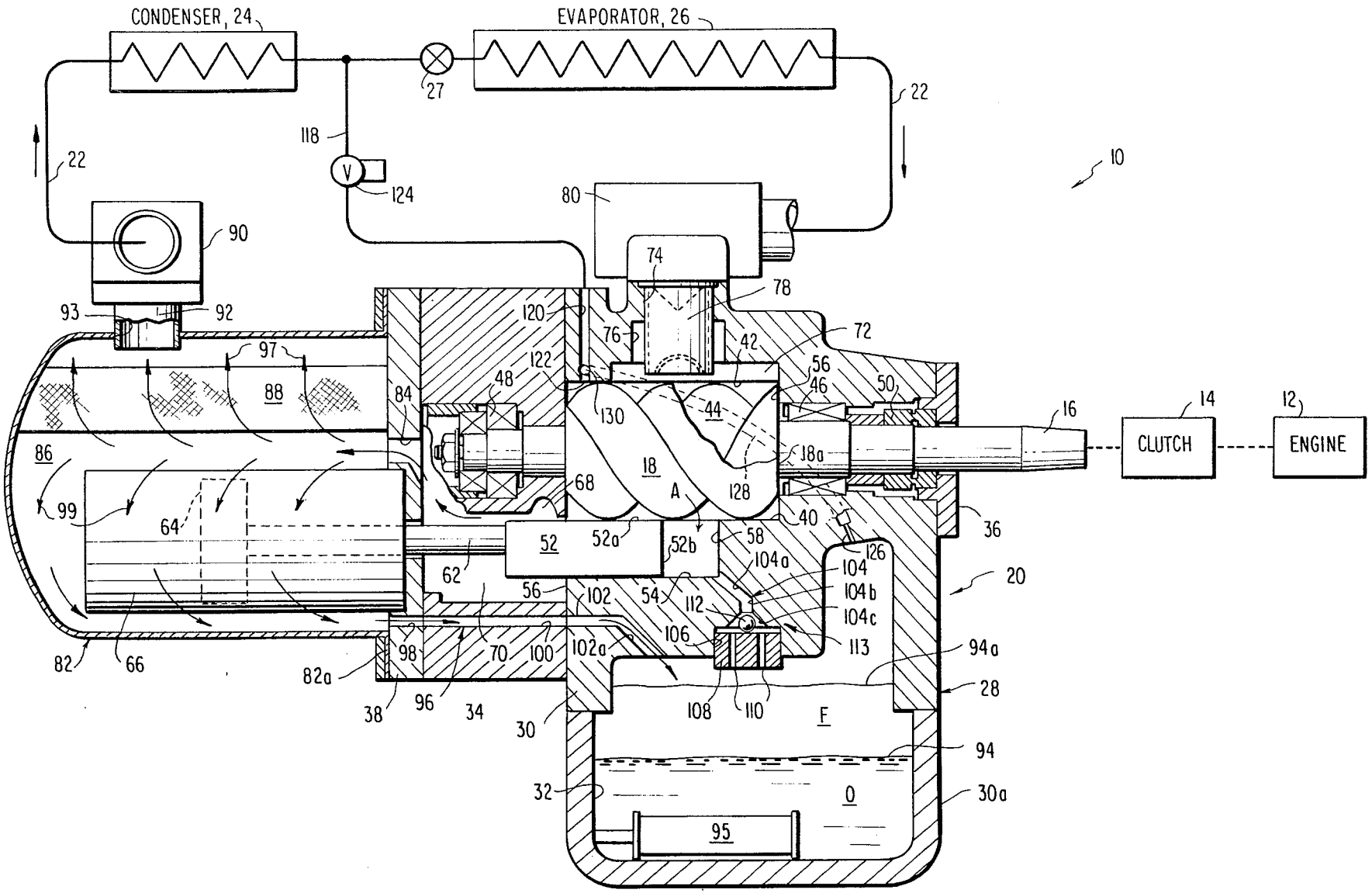
ENGINE
CLUTCH
EVAPORATOR, 26
CONDENSER, 24

HELICAL SCREW ROTARY COMPRESSOR FOR AIR CONDITIONING SYSTEM HAVING IMPROVED OIL MANAGEMENT

FIELD OF THE INVENTION

This invention relates to helical screw rotary compressors particularly employed in the motor vehicle field for providing air conditioning to such vehicles and to an oil management system which prevents hydraulic locking of the intermeshed helical screw rotors at compressor start up due to accumulation of the oil and miscibile condensed refrigerant in the rotor bores. It also relates to a method for insuring that the separated oil properly drains into the compressor oil sump.

DESCRIPTION OF THE PRIOR ART

Helical screw rotary compressors are particularly useful for refrigeration or air conditioning systems and especially air conditioning systems for fairly large size vehicles such as passenger buses. The internal combustion engine driving the bus is in constant operation as the bus proceeds along the highway, and depending upon the refrigeration requirements, the compressor is operated intermittently to meet the cooling needs of the bus passenger compartment. Typically, a mechanical clutch is employed to engage and disengage the helical screw rotors of the helical screw rotary compressor to the engine to effect rotation of those rotors. Specifically, one of the rotors (usually the female rotor) operates to drive the other. Such helical screw rotary compressors are characterized by a compressor housing or casing which includes a pair of parallel intersecting cylindrical bores within which intermeshed helical screw rotors are positioned for rotation about their axes, the rotors including integrally shaft portions projecting from opposite ends, with the shaft portions being supported by antifriction bearings such as tapered roller bearings, ball bearings or the like. Additionally, in order to modulate the capacity of the helical screw rotary compressor, it is conventional to mount a slide valve within a recess beneath the bores, normally aligned with the intersection of the intermeshed helical screw rotors. The slide valve on the face opening to the intersecting bores, has a surface which corresponds to the envelope of the compression process. The slide valve is shiftable longitudinally and is open at one end to the suction side of the machine, such that in moving away from the suction side of the machine, the compression chamber as defined by the intermeshed helical screw threads, is open to a greater or lesser extent back to the suction port to return working fluid without compression, thereby reducing the compression process and limiting the volume of compressed working fluid discharging from the compressor at the discharge port side of the intermeshed helical screw rotors. In such systems, the suction port opens to the intermeshed helical screw rotors at the top, that is, opposite the slide valve and at the suction port end of the machine. Further, the evaporator of the air conditioning or other vehicle mounted refrigeration system is sometimes positioned at a higher level than that of the compressor such that any condensed refrigerant and/or oil miscible therein within the evaporator, can, during compressor shut down, drain by gravity through the line connecting the evaporator to the compressor suction port, and into the area housing the intermeshed helical screw rotors defining the compression chamber. Additionally, the compressor structure is such that an oil passage is formed within the housing leading from the discharge side of the machine back to the oil sump so that any oil separated from the working fluid on the high pressure discharge side of the machine flows back to the sump which is maintained close to discharge pressure. Conventionally, an oil strainer within the accumulated volume of oil within the oil sump as defined by the bottom of the compressor housing feeds oil to various passages within the compressor housing leading to the bearings and the like for lubricating the bearings. Due to the pressure differential between the low pressure suction side of the machine and the high pressure discharge side of the machine, oil tends to flow towards the suction side of the machine, where it enters the compression chamber, functions to seal the threads of the rotors, both with themselves and the parallel bores housing the same. In some cases, the compressor is provided with pure oil mist lubrication systems such as that of applicant's U.S. Pat. No. 4,375,156 issued Mar. 1, 1983.

As may be appreciated, since the helical screw rotary compressor and the refrigeration system described to this extent may be employed in air conditioning of a large internal combustion engine driven vehicle such as a passenger bus, when the bus is not operating, there is no heat to the compressor. The oil within the sump or elsewhere will gradually absorb all of the liquid refrigerant since the fluids are totally miscible, one within the other.

In the past, it has been necessary to add heat to the oil during shut down to prevent condensation of the refrigerant vapor and the accumulation within the oil as a liquid, particularly within the oil sump of the compressor. Such requirements to provide heat rapidly drain the battery of a bus or like vehicle provided with such a refrigeration system.

It is, therefore, a primary object of the present invention to provide an improved helical screw rotary compressor for a bus air conditioning system of the like having improved oil management, wherein the refrigerant is permitted to be absorbed by the oil and wherein there is an assurance that the oil is prevented from accumulating within the compressor housing bores bearing the intermeshed helical screw rotors such that at engine start up, the clutch normally connecting the engine to the refrigeration system screw compressor will not burn out the clutch due to hydraulic locking of the intermeshed rotors mechanically connected to the engine through the clutch.

It is a further object of the present invention to provide an improved helical screw rotary compressor for a bus, or like vehicle, air conditioning system, refrigeration system, or the like, and wherein oil and condensed refrigerant are directed to the oil sump which is oversized such that regardless of total accumulation within the oil sump of oil and condensed refrigerant miscible therein it will not rise to a level reaching the intermeshed helical screw rotors, and wherein at start up, the suction side of the machine is automatically cut off from the oil sump.

It is a further object of the present invention to insure that in such system oil separated in the separator is caused to return properly to the compressor oil sump.

SUMMARY OF THE INVENTION

The invention is directed to an improved helical screw rotary compressor for a closed loop refrigeration system including a helical screw rotary compressor, a condenser and an evaporator, including conduit means connecting the compressor, the condenser and the evaporator in a closed loop series refrigeration circuit, in that order, with an expansion valve means upstream of the evaporator, and wherein the compressor comprises a housing including intersecting parallel bores, intermeshed helical screw rotors mounted for rotation within the bore, a recess underlying the rotors and open to the rotors, a slide valve slidably mounted in the recess for selectively closing off the recess at the end adjacent the suction port side of the machine. A mass of refrigerant is provided within the closed loop system along with a mass of lubricating oil. An oil sump defined by the housing underlies the intermeshed helical screw rotors and the slide valve for accumulating oil. The improvement lies in the sump being of a capacity at least 1.5 times the volume of oil required for lubrication of the compressor, and wherein the compressor further comprises oil drain passage means leading from the recess to the sump, and a ball check valve within that passage means for permitting oil and liquid refrigerant draining back to the compressor upon shut down of the refrigeration system, to further drain from the recess into the oil sump. Further oil drain passage means leads from the discharge port side of the compressor back to the sump for causing the sump to be at discharge pressure during normal operation of the compressor, whereby during compressor shut down, the refrigerant may freely condense and be absorbed by the oil without liquid flooding of the helical screw rotors and hydraulic locking of the rotors and damage to the compressor drive system during compressor start up, and wherein, upon compressor start up, the slide valve recess is cut off from the oil sump to prevent refrigerant blow-by from the discharge side of the machine through the oil drain passage means from the discharge port to the sump and from the sump via the oil drain passage means leading to the slide valve recess to the suction side of the compressor.

The compressor housing may be provided with an auxiliary housing sealably connected to the side of the compressor housing proximate to the compressor discharge port and defining an auxiliary chamber. A passage within the compressor housing connects the compressor discharge port to the auxiliary chamber. An outlet port within the top of the auxiliary housing is connected directly to the inlet side of the condenser. An oil separator is mounted within the auxiliary chamber for separating oil from the compressed refrigerant vapor discharging into the auxiliary chamber from the compressor housing discharge port. One oil drain passage extends through the compressor housing from the auxiliary chamber at the bottom of the auxiliary chamber and opens to the sump for permitting separated oil in the auxiliary chamber to drain to the sump.

The sump may in turn be vented, at its highest point, and via a restricting orifice, to a closed thread of the compressor at a pressure lower than discharge pressure in order to insure a slightly lower pressure in the oil sump than in the separator thus ensuring effective draining of the separated oil into the sump. The separated oil is usually in a foaming state and as refrigerant is continually evolving from this oil, it tends to inhibit oil from returning from the separator to the sump. A very slight reduction in sump pressure very effectively overcomes this tendency and insures excellent separation.

The evaporator is sometimes positioned at a level higher than the screw compressor and the outlet of the evaporator is connected via a suction passage and terminates at the compressor suction port opening to the parallel intersecting bores housing the helical screw rotors, such that any refrigerant and/or oil flooding the evaporator during system operation drains through the intermeshed helical screw rotors and the slide valve recess to the sump during compressor shut down. A ball check valve may be provided within the passage within the compressor housing leading to the compressor suction port to permit flow of refrigerant/oil from the evaporator back to the compressor oil sump but prevent reverse refrigerant/oil flow.

The present invention has particular application to a motor vehicle air conditioning system in which the compressor is engine driven through a clutch and wherein the oil management system insures against oil and entrained liquid refrigerant flooding the bores bearing the intermeshed helical screw rotors and hydraulic locking the rotors after sustained compressor shut down at the next start up of the engine and the compressor air conditioning system.

BRIEF DESCRIPTION OF THE DRAWING

The single FIGURE is a partial vertical sectional view and schematic diagram of a closed loop bus air conditioning system including a helical screw rotary compressor with improved oil management forming a preferred embodiment of the present invention.

DESCRIPTION OF THE PREFERRED EMBODIMENT

Referring to the FIGURE, while the present invention may have application to any compressed gas, closed loop, recirculation system employing a helical screw rotary compressor or other type compressors where the same problem exists, and wherein the working fluid is a vaporizable and condensable liquid which is miscible with the oil employed in lubricating the compressor moving parts and for sealing the compression working chamber, the present invention is particularly applicable to an internal combustion engine clutch driven helical screw rotary compressor employed within an air conditioning or refrigeration system for the engine driven vehicle. The closed loop air conditioning system 10, as illustrated, lies within a passenger bus or the like vehicle having an internal combustion engine as at 12, which is directly coupled through clutch 14 to a rotor shaft 16 integral with the female helical screw rotor 18 of a helical screw rotary compressor indicated generally at 20. The compressor is one element of the closed loop refrigeration circuit formed by conduit means 22 connecting compressor 20 in series, and in that order, with a condenser 24 and an evaporator 26.

In a conventional fashion, a thermal expansion valve indicated generally at 27 is provided within conduit or line 22 upstream of, and at the inlet side of evaporator 26. In the illustrated system, a conventional refrigerant such as R12 may be employed with compressor 20 comprising a horizontal axis compressor of relatively small capacity, vehicle mounted within a multi-passenger bus, for example and with the compressor driven through clutch 14 by the vehicle drive engine 12.

The invention is particularly directed to the compressor 20. Compressor 20 comprises a multi-section compressor housing or casing 28 including a central or main housing section 30 including a depending main housing section portion 30*a* which defines internally with section 30 an oil sump at 32. The housing 28 additionally includes a high side bearing housing section as at 34, a low side or rotary seal end plate as at 36, and a high side or discharge side, end plate 38. The main housing section 30 is provided with side by side intersecting cylindrical bores as at 40 and 42 within which are mounted female helical screw rotor 18 and a male helical screw rotor 44, respectively, the rotors being intermeshed via their threaded peripheries. Duplicate or near duplicate bearing assemblies are provided for the shafts integral with the rotors and about portions extending axially from opposite ends. Shaft 16 is shown as being mounted on the suction or low pressure side by way of straight roller bearing pack assembly 46 and on the high pressure discharge side by bearing pack assembly 48. The bearing pack assemblies 46 and 48 may comprise dual ball bearings, dual roller bearings or single ball or roller bearings. Additionally, appropriate seals are required as at 50 for sealing off the compression chamber defined by the intermeshed helical screw rotors 18 and 44, the bores 40 and 42 within which they reside as well as an upper surface 52*a* of a slide valve 52. Slide valve 52 is slidably mounted within recess 54 within the main housing section 30 directly underlying portions of the intermeshed helical screw rotors 18 and 44. The surface 52*a* of the slide valve conforms to the peripheries of the intermeshed rotors and is normally located so as to straddle the intersection between the two rotors. Recess 54 extends inwardly from end wall 56 on the high pressure or discharge side of the compressor towards the low pressure side as defined by end 18*a* of female rotor 18. Recess 54 terminates in a vertical end wall 58 against which the end 52*b* of the slide valve abuts when the compressor is under full load operation. The slide valve 52 reciprocates and is slidably positioned so as to selectively close off a return path for the gas being compressed, back to the suction side of the machine, in conventional fashion. The slide valve 52 is mechanically coupled by rod 62 to a piston indicated in dotted lines at 64 within unload cylinder 66.

As defined partially by housing section 34 and the slide valve 52, there is provided a high pressure discharge port 68 for the compressor which opens to a cavity 70 within housing section 34 through which the piston rod 62 passes leading from slide valve 52 to the piston 64 of the unload cylinder 66. End plates 36 and 38 are mounted to compressor housing sections 30 and 34 and these two sections are connected together and sealed at their interfaces by means of mounting bolts or screws (not shown) and sealed by way of appropriate O-rings (not shown) or the like in conventional fashion.

Within main housing section 30, in addition to the recess 54 which may be of modified rectangular cross-section, a further recess is provided at 72 which defines the suction port for the compressor. The housing section 30 is bored at 74 and counterbored at 76. Within bore 74, there is provided a cylindrical check valve 78 which leads to a terminal or fitting 80 connected directly to line 22 which leads from the outlet side of evaporator 26 thereby permitting the return of refrigerant vapor with or without entrained oil to the low pressure or suction side of the machine as defined by suction port 72. This low pressure vapor is captured between the intermeshed threads of the helical screw rotors 18 and 44 and compressed to a high pressure prior to discharge through compressor discharge port 68 into cavity 70.

While cavity 70 could be connected directly to the inlet side of condenser 24 through line 22, instead compressor 20 is provided with an auxiliary casing or housing indicated generally at 82 in the form of a sheet metal cup having a flanged end 82*a* which directly abuts and is sealably fashioned to the outside surface of end plate 38. Additionally end plate 38 is provided with a hole or opening at 84 which opens to the auxiliary chamber 86 defined principally by the auxiliary housing 82. The chamber 86 houses two components: the unload cylinder 66 and a nylon or aluminum mesh oil separator 88, the oil separator 88 being formed of a non-woven fabric preferably of nylon or aluminum.

Mounted to the auxiliary housing 82 is an outlet fitting or terminal 90 which connects directly to line 22 on the inlet side of condenser 24, the fitting 90 being provided with a small diameter tubular portion 92 which opens directly to the interior to the auxiliary chamber 86 of the compressor, being fitted to opening 93 within auxiliary housing 82.

It is important to note that, in conventional compressor operation, oil O under near discharge pressure passes through oil strainer 95 and through small diameter passages (not shown) within housing 28 by pressure differential to the rotor bearing pack assemblies such as bearing pack assemblies 46 and 48 for lubrication of the bearings at the bearing locations. This oil is entrained in the working fluid and passes through the compression process discharging at the compressor discharge port 68 opening to cavity 70 within housing section 34.

The discharging refrigerant in vapor form carrying the oil enters the auxiliary chamber 86 via hole or passage 84 within end plate 38, impinging against the non-woven mesh oil separator 88 where a major portion, if not all of the oil, separates. The refrigerant passes through the oil separator as indicated by arrows 97, while the oil falls to the bottom of auxiliary housing 82 as indicated by arrows 99. The oil free refrigerant as a highly compressed vapor passes to the condenser 24 via fitting 90 and closed loop line or conduit 22.

As part of the improved oil management scheme, there is a first oil passage means indicated generally at 96 and leading from the bottom of auxiliary chamber 86 to oil sump 32. In that respect, a small diameter hole 98 passes through end plate 38, and opens directly to a similarly sized hole or passage 100 extending horizontally through housing section 34. In turn, passage 100 opens to a further passage or hole 102 within housing main section 30, that passage 102 terminating in a downwardly inclined portion 102*a* leading to sump 32.

Passage means 96 therefore permits the oil sump 32 to be close to discharge pressure and tends to permit any oil within auxiliary chamber 86 particularly that oil separated by oil separator 88 to flow by gravity, when the compressor is shut down and all internal pressures are equal, from the auxiliary chamber 86 to the oil sump 32 including condensed refrigerant miscible with the oil.

An important aspect of the present invention is the provision of a second oil drain passage means indicated generally at 104 which leads from recess 54 bearing the slide valve 52 to the oil sump 32. As may be appreciated, due to the vertically raised positioning of the evaporator 26, above compressor 20 any flooding of the evaporator permits the condensed refrigerant and oil miscible therein, to gravity drain through line 22, fitting 80, check valve 78 suction port 72, the intersecting bores 40 and 42 housing the helical screw rotors 18 and 44, the underlying recess or cavity 54 bearing slide valve 52 and the second oil drain passage means 104 to the sump 32. Passage means 104 includes an inclined passage portion 104*a* terminating in a vertical passage portion 104*b* which is concially enlarged at 104*c*. Additionally, an annular recess 106 is provided within the housing section 30 which receives a perforated circular disc or cage 108 which bears a series of holes at 110 and which underlies a drainage ball 112, these elements defining a drainage ball check valve indicated generally at 113. The drainage ball check valve 113 therefore permits, upon compressor shut down and the equalization of compressor discharge pressure to suction pressure, any accumulated oil within the evaporator 26, the compressor working chamber or the open area of slide valve recess housing 54 to drain via second drain passage means 104 back to the oil sump 32.

It must be kept in mind that the capacity control system defined by slide valve 52 and driven by the unload cylinder 66 operates conventionally. Automatically, at the time of compressor shut down, the slide valve is shifted to the full unload position shown, that is, where the volume of the cavity or recess 54 uncovered by the slide valve in moving to the left is at a maximum, thereby returning the major portion of the refrigerant vapor uncompressed back to the suction side of the machine as defined by suction port 72. Therefore, the complete volume A of slide valve recess 54 becomes part of the drain passage for evaporator 26, line 22 and the compressor working chamber as defined by the intermeshed helical screw rotors 18 and 44. Since the compressor 20 and the refrigeration system 10 employing the same is a component of a large vehicle such as a passenger bus, when the bus is not operating, that is, at shut down, there is no heat provided to compressor 20. The oil O will gradually absorb all of the liquid refrigerant indicated schematically at F increasing the level of the miscible, condensed refrigerant and the oil to level 94*a* from level 94 which is the level of the oil necessary to the system for effecting lubrication. While the schematic representation illustrates the refrigerant F as being separate from the oil, in actuality, the oil gradually absorbs all the liquid refrigerant since the fluids are totally miscible, one within the other. The refrigerant vapor condenses into the oil due to the differences in the vapor pressure of the oil and the refrigerant. Assuming that the bus is parked overnight at an ambient temperature of 70 degrees F., at shut down, the R12 refrigerant F will generate at that temperature a vapor pressure of 100 psi while the oil at 70 degrees F. generates zero vapor pressure within sump 32.

As mentioned previously, the surface of the oil being constantly bombarded by the high vapor pressure refrigerant F, causes the refrigerant F to dissolve (condense on the surface and being miscible in the oil). While there is some heat rejection given off during condensation of the refrigerant vapor, since the compressor is shut down, there is no build up of heat due to the normal dissipation through the metal compressor housing 28. The system operation may be likened to a precooling system or even a minor absorption refrigeration cycle in that respect.

The present invention has, as an element of its novel aspect, the sizing of the main compressor housing section component 30*a* so as to produce a volume for the sump 32 which is at least 1.5 times the volume necessary to retain the lubricating oil for the system at compressor shut down. Even with all of the refrigerant charge F within the system condensing and returning to the oil sump 32, the extent of the oil level with entrained miscible refrigerant F rises only to level 94*a*. Therefore, not only does the oil management system components insure drainage of the oil and condensed refrigerant to the oil sump 32, but insures that the sump is sufficiently oversized so that accumulated oil and entrained miscible refrigerant will not reach the level of the intermeshed helical screw rotors 18 and 44 within bores 40 and 42, respectively. The sump may have twice the volume capacity over and above that necessary to accumulate the oil charge. Therefore, after a night of parking of the bus within a parking lot, the starting of the bus internal combustion engine 12 and the energization of compressor 20 and the engagement of compressor 20 with the engine 12 via clutch 14, will not result in burning out the clutch since there is no accumulated liquid within the bores housing the intermeshed helical screw rotors 18 and 44 and thus no hydraulic lock preventing the rotors from rotating. The drainage ball check valve 113 automatically opens when the compressor is declutched to let any fluid which may drain back into the compressor through the suction line from evaporator 26 to suction port 72 or through any other line leading to the compression area to drain back into the oil sump 32. At start up, this check valve will immediately shut due to the establishment of compressor discharge pressure within the oil sump 32 driving the ball check valve towards closed position.

As indicated, a liquid refrigerant injection line 118 leads from the condenser 24 at its outlet and includes a vertical passage 120 within main housing section 30 of compressor 20, passage 120 terminating in a liquid injection port 122 which opens to the intermeshed helical screw rotor threads defining the compression chamber upstream of the discharge port 68 and also closed off from the suction port 72 of the compressor. Injection flow is controlled by valve 124.

Preferably, the sump 32 may, in turn, be vented at its highest point (or in the vicinity thereof) via a restricting orifice as at 126 within an oil sump vent communication passage 128 drilled or otherwise suitably formed within housing 30, the passage 128 leading from sump 32 and terminating at a closed thread of the compressor at a pressure lower than discharge pressure. In the illustrated embodiment, schematically the oil sump vent communication passage 128 opens at the end remote from the sump at port 130 within passage 120, for example, which carries the liquid refrigerant for liquid refrigerant injection. Alternatively, port opening 130 could be within a parallel passage to passage 120 or open directly through one of the bores 40, 42 at a closed thread where the pressure is lower than the discharge pressure of the compressor. This insures a slightly lower pressure in the oil sump than in the auxiliary chamber 86 housing the oil separator 88, thus insuring effective draining of the separated oil into the sump 32. The separated oil is usually in a foaming state and as a refrigerant is continuously evolving from the oil O, it tends to inhibit oil from returning from the separator to the sump. A very slight reduction in sump pressure very effectively overcomes this tendency and insures excellent separation of the oil and drainage to sump 32.

As may be additionally appreciated, if the slide valve 52 is moved completely to the right from the full unload position shown to the full load position, volume A is reduced to zero and second oil drain passage means 104 is shut off. However, this is immaterial since under those conditions, the ball check valve 113 is closed and there is no communication between the oil sump 32 and the area of compression as defined by the intermeshed helical screw rotors 18 and 44, except via orifice 126.

While the invention has been particularly shown and described with reference to a preferred embodiment thereof, it will be understood by those skilled in the art that various changes in form and details may be made therein without departing from the spirit and scope of the invention.

What is claimed is:

1. An improved helical screw rotary compressor for a closed loop refrigeration system, said closed loop refrigeration system including:

a helical screw rotary compressor, a condenser, an evaporator, conduit means connecting said compressor, said condenser and said evaporator in a closed loop series refrigeration circuit, in that order, expansion valve means within said closed loop circuit upstream of said evaporator, said compressor comprising:

a housing including intersecting parallel bores, intermeshed helical screw rotors mounted for rotation within the bores, a recess underlying the rotors and being open to the rotors, a slide valve slidably mounted in the recess, said compressor housing defining a low pressure suction port adjacent one end of said intermeshed helical screw rotors and a high pressure discharge port adjacent the opposite end of said intermeshed helical screw rotors, said slide valve and said recess being sized and located such the slide valve selectively closes off the recess at the end proximate the suction port of the compressor, a mass of vaporizable refrigerant being provided within the closed loop circuit, an oil sump bearing oil defined by the housing and underlying the intermeshed helical screw rotors and the slide valve for accumulating oil;

the improvement wherein, said sump is of a capacity of at least the total volume of the oil required for lubrication of the compressor and said refrigerant when in liquid form, and wherein said compressor further comprises first oil drain passage means leading from the compressor discharge port back to the sump passage for causing the sump to be at discharge pressure during normal operation of the compressor and forming a gravity flow passage, and second oil drain passage means leading from the recess housing said slide valve back to said sump, a ball check valve within said second oil drain passage means for permitting oil and liquid refrigerant, upon shut down of the refrigeration system, to drain from the recess into the oil sump but preventing reverse flow therebetween;

whereby, during compressor shut down, the refrigerant may freely condense and be absorbed by the oil and drain to said sump without liquid flooding of the intermeshed helical screw rotors and hydraulic locking of the rotors and damage to the compressor drive system during compressor start up, and wherein upon compressor start up, the slide valve recess is cut off from the oil sump to prevent refrigerant flow from the discharge side of the machine through the first oil drain passage means from the discharge port to the sump, and thence from the sump via said second oil drain passage means through the slide valve recess to the suction port of the compressor.

2. The compressor as claimed in claim 1, further comprising a restricted passage within said compressor housing leading from said sump at a point above the level of oil and miscible refrigerant during compressor shut down to a closed thread of the helical screw rotors at a pressure lower than compressor discharge pressure to insure a slightly lower pressure in the oil sump than in the area of compressor discharge and to thus provide effective drainage of any oil separating from the compressor discharge through said first oil drainage passage means back to the sump.

3. The compressor as claimed in claim 1, wherein said compressor housing further comprises an auxiliary housing sealably connected to the side of the compressor housing proximate to the compressor discharge port and defining an auxiliary chamber, a passage within the compressor housing connecting the compressor discharge port to the auxiliary chamber, a housing outlet port within the auxiliary housing connected directly to the inlet side of the condenser, an oil separator being mounted within the auxiliary chamber intermediate of the housing outlet port and the passage within the compressor housing connecting the compressor discharge port to the auxiliary chamber for separating oil from the compressor refrigerant vapor discharging into the auxiliary chamber from the compressor discharge port, and wherein said first oil drain passage means comprises an oil drain passage extending through the compressor housing from the auxiliary chamber opening at one end to the bottom of the auxiliary chamber and opening to the sump at the other end for permitting separate oil in the auxiliary chamber to gravity drain to the sump and for maintaining the sump at the compressor discharge pressure.

4. The compressor as claimed in claim 2, wherein said compressor housing further comprises a restricted oil sump vent communication passage having one end opening to said sump at a level above the level of accumulated condensed refrigerant and oil during compressor shut down and a closed thread defined by the intermeshed helical screw rotors at a pressure lower than the compressor discharge pressure for insuring a slightly lower pressure in the oil sump than in said auxiliary chamber to eliminate oil foaming and to prevent said foam from inhibiting oil return from the auxiliary chamber to the sump.

5. The compressor as claimed in claim 1, wherein said evaporator is positioned at a level higher than the screw compressor and the outlet of the evaporator is connected via a suction passage within the compressor housing to said compressor suction port such that any refrigerant and oil flooding the evaporator during system operation gravity drains through the intermeshed helical screw rotors and the slide valve recess to the sump during compressor shut down, and wherein a second check valve is provided within the passage within the compressor housing leading from the evaporator to the compressor suction port to permit the flow of condensed refrigerant and miscible oil therein from the evaporator back to the compressor upon compressor shut down, but prevent reverse refrigerant flow.

6. The compressor as claimed in claim 3, wherein said evaporator is positioned at a level higher than the screw compressor and the outlet of the evaporator is connected via a suction passage within the compressor housing to said compressor suction port such that any refrigerant and oil flooding the evaporator during system operation gravity drains through the intermeshed helical screw rotors and the slide valve recess to the sump during compressor shut down, and wherein a second check valve is provided within the passage within the compressor housing leading from the evaporator to the compressor suction port to permit the flow of condensed refrigerant and miscible oil therein from the evaporator back to the compressor upon compressor shut down, but prevent reverse refrigerant flow.

7. The compressor as claimed in claim 6 wherein the volume of said sump is at least 1.5 times the volume of the oil required for lubrication.

8. In combination, a closed loop refrigeration system for an engine driven motor vehicle, said closed loop refrigeration system comprising:

a helical screw rotary compressor, a condenser, an evaporator, conduit means connecting said compressor, said condenser and said evaporator in a closed loop series refrigeration circuit, in that order, and an expansion valve means within said conduit means upstream of said evaporator, said compressor comprising a housing including intersecting parallel bores, intermeshed helical screw rotors mounted for rotation within said bores, said rotors including integral shafts, anti friction bearing pack assemblies carried by said housing, about said shafts for rotatably supporting said intermeshed helical screw rotors for rotation about the shaft axes, a recess underlying said rotors and open to said rotors, a slide valve slidably mounted in said recess, said housing defining a low pressure suction port open to said intermeshed helical screw rotors at one end of said rotors and a high pressure discharge port at the opposite end of said rotors, said slide valve being slidably mounted in said recess for selectively closing off the recess at an end proximate to said suction port, a mass of refrigerant provided within said closed loop system, an oil sump bearing a mass of oil, and defined by said housing underlying the intermeshed helical screw rotors and the slide valve.

means for supplying oil under pressure to said bearings for lubrication of the bearing, such that oil lubricating the bearings adjacent to the suction port tends to move into the compressor area under pressure differential between the discharge port and the suction port, said vehicle comprising an internal combustion engine, clutch means mechanically connecting said engine to one of said rotor shafts for driving said intermeshed helical screw rotors about their axes, the improvement comprising:

said sump being of a capacity of at least the volume of the oil required for lubrication of the compressor and the mass of refrigerant when in liquid form, said compressor further comprising first gravity flow oil drain passage means operatively connecting the discharge port to the sump for causing said sump to be at discharge pressure during normal operation of the compressor, and second oil drain passage means leading from the recess to the sump, and a ball check valve within said second oil drain passage means for permitting oil and liquid refrigerant draining back to the compressor upon shut down of the refrigeration system from said evaporator to drain from the recess into the oil sump but preventing reverse flow;

whereby, during compressor shut down, the refrigerant may freely condense and be totally absorbed in the oil and fill said sump without liquid flooding of the intermeshed helical screw rotors and hydraulic locking of the rotors to prevent damage to the clutch means or engine upon compressor start up, and wherein, during start up, the slide valve recess is cut off from the oil sump to prevent refrigerant blow by from the discharge port side of the compressor through the first oil drain passage means to the sump and from the sump via said second oil drain passage means to the suction port of said compressor.

* * * * *